US007263944B1

(12) United States Patent
Smith

(10) Patent No.: US 7,263,944 B1
(45) Date of Patent: Sep. 4, 2007

(54) PORTABLE UNIVERSAL SKI BOAT PYLON

(75) Inventor: Michael Smith, Higley, AZ (US)

(73) Assignee: Michael L. Smith, Higley, AZ (US)

( * ) Notice: Subject to any disclaimer, the term of this patent is extended or adjusted under 35 U.S.C. 154(b) by 0 days.

(21) Appl. No.: 11/494,002

(22) Filed: Jul. 27, 2006

(51) Int. Cl.
*B63B 21/04* (2006.01)

(52) U.S. Cl. ..... 114/253

(58) Field of Classification Search ..... 114/242, 114/253, 254

See application file for complete search history.

(56) References Cited

U.S. PATENT DOCUMENTS 3,890,918 A * 6/1975 Sell ..... 114/253
4,213,413 A * 7/1980 Courtney ..... 114/253
5,934,217 A * 8/1999 Allsop ..... 114/242
5,943,977 A * 8/1999 Womack et al. ..... 114/242
6,119,617 A * 9/2000 Oswell ..... 114/253
6,192,819 B1 * 2/2001 Larson et al. ..... 114/253
6,374,762 B1 * 4/2002 Larson et al. ..... 114/253
6,575,112 B2 * 6/2003 Roeseler et al. ..... 114/253

* cited by examiner

*Primary Examiner*—Stephen Avila

(57) ABSTRACT

A temporarily mounted towing device for towing a water sporter as part of a water sporting activity. An elongate towing member is stowed within a storage housing temporarily secured to the bottom of a watercraft. The storage housing extends upwardly from the bottom of the boat in a nominally vertical direction. The towing member remains in a vertical orientation to operate as a pylon towing device. To stabilize the pylon, front and rear nylon tie downs or similar removable bracing devices are used on both sides of the towing vehicle.

5 Claims, 3 Drawing Sheets

PORTABLE UNIVERSAL SKI BOAT PYLON

FIELD OF THE INVENTION

The present invention relates generally to booms and pylons used for water sports activities. More particularly, it concerns a temporarily mounted pylon that is easily installed and removed without mounting plates.

BACKGROUND OF THE INVENTION

The term "water sport" as used herein shall refer generally to water activities accomplished through the use of watercraft, including, but not limited to, wake boarding, knee boarding, water skiing, barefoot water skiing, and any other water sport activity utilizing a tow rope and watercraft.

Towable water sports devices are used in various recreational and professional activities. These devices include water skis, kneeboards, wakeboards, water ski boards, tubes and other devices which are towed behind a motor boat or other towing vessel along with a rider. Typically, the rider stands, kneels, or sits on the device, and a towline is held by the rider or attached to the device.

Wakeboarding, for example, is a recreational and professional sport that is rapidly increasing in popularity. In wakeboarding and other water sports, it is often desirable to jump off the water surface to add excitement to the activity, perform tricks or other aerial maneuvers, etc. Often, the wake created by the towing vessel is used as a ramp to facilitate jumping off the surface of the water. However, regardless of the amount of wake present, riders will often want to maximize the ability to jump off the water surface.

Accordingly, motor boats have been provided with elevated anchor points typically called wake towers to accommodate a higher angle of attachment of the rider towline. Typically, a pylon, tower or like structure extends several feet above the deck of the boat (e.g., approximately 8-10 feet). This slightly increases the angle formed by the rider towline with the surface of the water. The resulting upwardly directed force component allows the rider to jump higher off the water surface.

Various constraints limit the advantages obtained through use of such elevated anchor points. Typically, there are practical and other limitations on the height of elevated anchor point structures, for example hauling or fold-away limitations. Large towers can flex significantly, requiring stabilizing guy wires or other structural reinforcements within the boat. Towers can also adversely affect the stability of the towing vessel, due to leveraged forces exerted by the rider towline on the tower, particularly when the rider pulls from one side of the motor boat. For these and other reasons, the jumping advantage provided by an elevated anchor point within a boat is limited.

The unfortunate byproduct of this thinking has been an encumbrance of the already limited storage space in the watercraft. These various accessories also take up valuable space when they are detached and stored in the boat during periods of nonuse. Another disadvantage is that the various pylon, elevated pylon and boom accessories can be cumbersome, laborious and time-consuming to attach and remove.

SUMMARY OF THE INVENTION

It is therefore an object of the present invention to provide a towing device for water sporting that is less cumbersome, laborious and time-consuming to use, attach or remove.

It is another object of the invention, in accordance with one aspect thereof, to provide such a towing device that is padded and collapsible, and also stowable in a vertically extending storage space in a watercraft.

It is a further object of the invention, in accordance with one aspect thereof, to provide such a towing device that can function as a pylon, elevated pylon or boom.

The above objects, and others not specifically recited, are realized in a specific illustrative embodiment of a towing device for towing a water sporter as part of a water sporting activity. An elongate towing member is stowed within a storage housing temporarily placed to the bottom of a watercraft. The storage housing extends upwardly from the bottom of the boat in a vertical direction. The towing member remains in an upward orientation to operate as a pylon towing device. In order to stabilize the device within the vehicle, nylon tie downs or similar bracing devices are attached forward and aft, starboard and ports sides.

Additional objects and advantages of the invention will be set forth in the description which follows, and in part will be apparent from the description, or may be learned by the practice of the invention without undue experimentation. The objects and advantages of the invention may be realized and obtained by means of the instruments and combinations particularly pointed out in the appended claims.

ILLUSTRATIONS

DETAILED DESCRIPTION OF AN ENABLING AND PREFERRED EMBODIMENT

Figure 1:
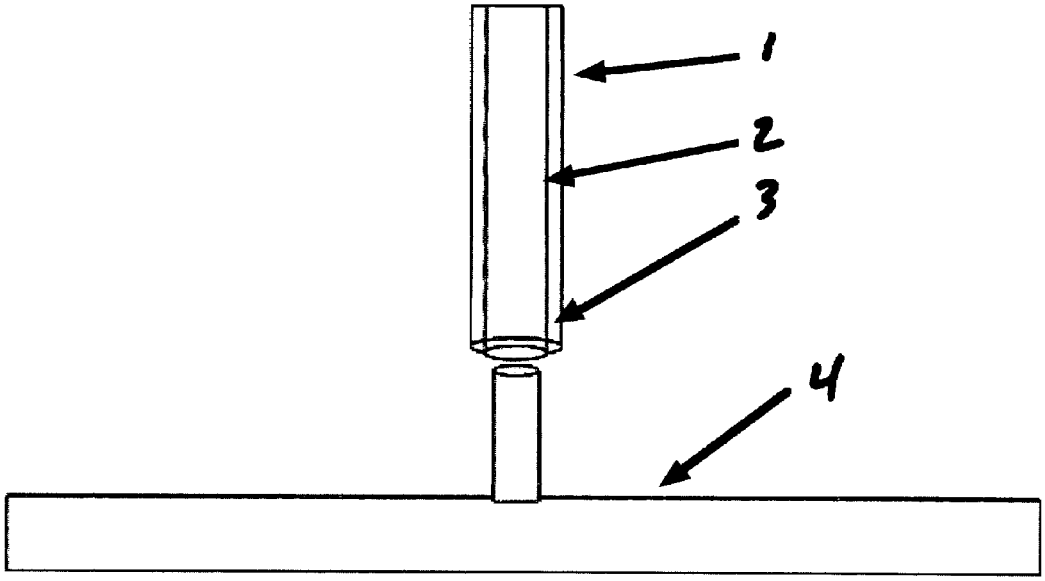
FIG. 1 illustrates a side view of the invention.
Figure 2:
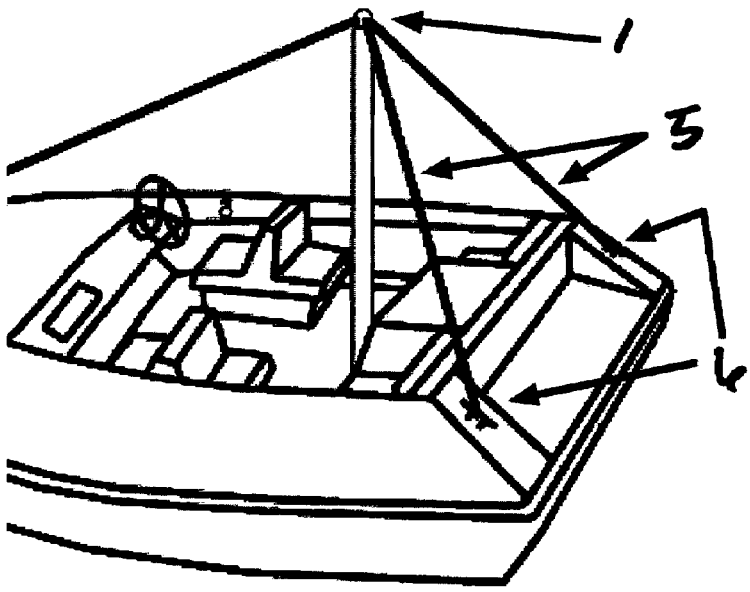
FIG. 2 illustrates a front cutout view of the invention.
Figure 3:
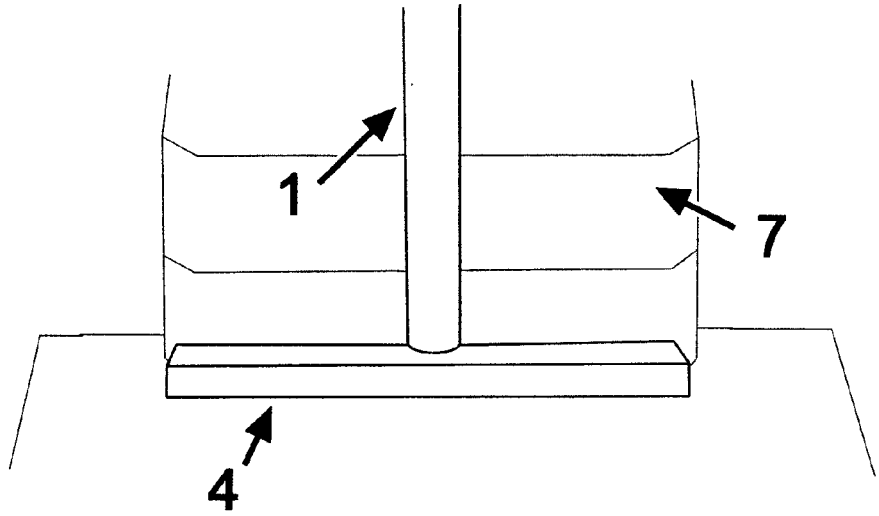
FIG. 3 illustrates a top view of the invention.
Figure 4:
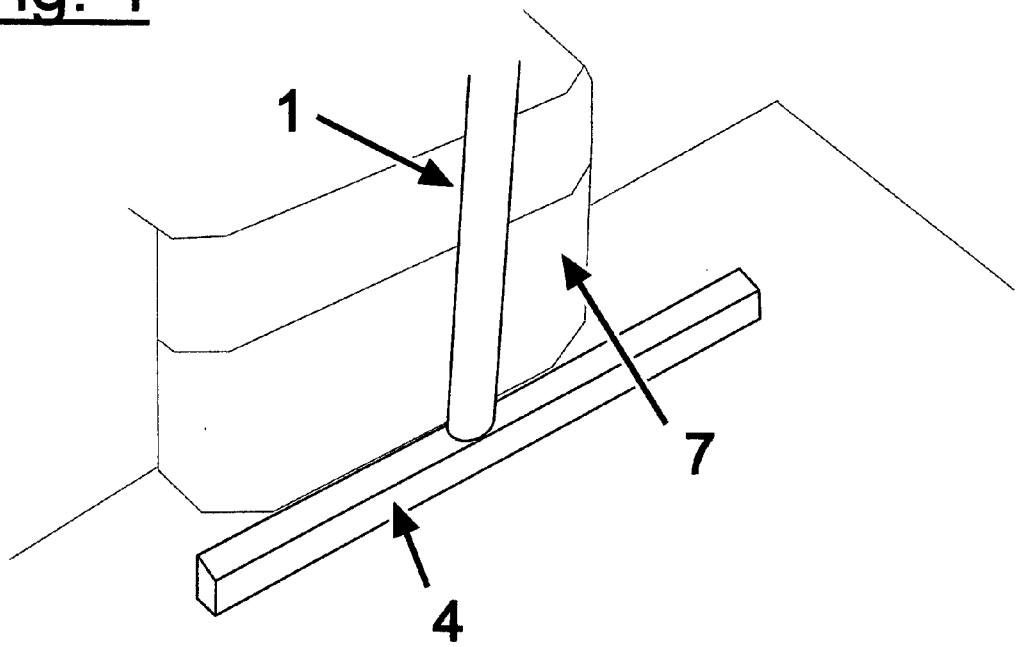
FIG. 4 illustrates another angular view of the invention.
Figure 5:
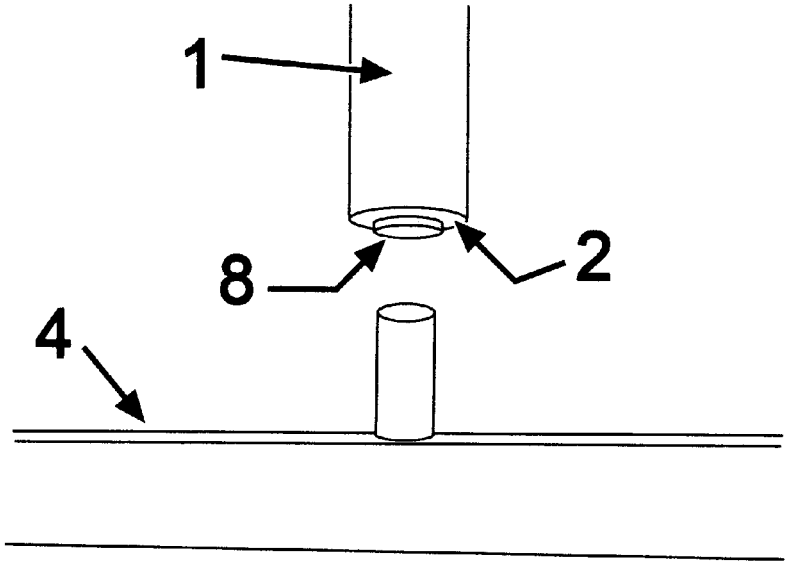
FIG. 5 illustrates the parts of the invention.
Figure 6:
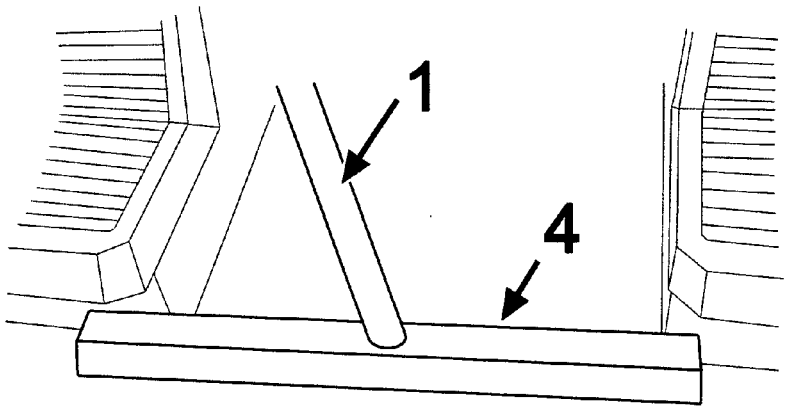
FIG. 6 illustrates another angle of the invention.

FIG. 1 illustrates how the pylon mast 1 is wrapped with padding 3 around the pole 2 held vertically above the base 4. FIG. 2 illustrates the pylon 1 mounted vertically and held into place by the tie downs 5, and the rope cleats 6. FIG. 3 illustrates the pylon 1 mounted to the base 4 in reference to the engine 7. FIG. 4 illustrates another angle of the pylon 1, engine 7 and base 4 are arranged. FIG. 5 illustrates how the pylon 1 fits onto the base 4, using the tube 8 in conjunction with the padding 2. FIG. 6 illustrates another angle of the pylon mast and the base.

The illustrations and examples provided herein are for explanatory purposes and are not intended to limit the scope of the appended claims, as those skilled in the art will make modifications to the invention for particular uses.

What is claimed is:

1. A towing device for towing a water sportsman as part of a water sport activity, said device comprising:

a horizontal elongated towing member comprising a base portion, an elongated padded vertical upper portion, and coupling means for movably coupling said upper portion to said base portion in a manner sufficient to render said upper portion moveable relative to the base portion from a first;

second attachment means for attaching a first end of a tow line to a first attachment point on a distal end section of the towing member and pulling said tow line in tension as said tow line is held by a water sporter or water sporting device to thereby tow said water sporter or water sporting device along a water surface when said towing member is disposed;

Third attachment means for stabilizing the padded vertical member to the towing vehicle is four adjustable horizontal members, forward and aft, starboard and port sides.

2. The towing device of claim 1, wherein the upper portion of the towing member has a first, length, and wherein the coupling means further comprises lengthening means for lengthening said upper portion to a second, extended length to thereby elevate the first attachment point and first end of the tow line when said upper portion resides in the first position such that the tow line defines a towing angle relative to the water surface when said tow line is held in tension by a water sporter being towed along the water surface, said towing angle producing a smaller downward component of force in the tow line than it would have when said upper portion is disposed in its first length.

3. The towing device of claim 2, wherein the upper portion of the towing member and the lengthening means collectively comprise a series of telescopically connected sections and a holding means for holding the telescoping sections in fixed positions with respect to each other when the upper portion is disposed in its second, extended length.

4. The towing device of claim 2, further comprising:

bracing means for interconnecting the elongate upper portion with the watercraft and thereby counteracting forces imposed against said elongate upper member by the water sporter.

5. The towing device of claim 4, wherein the bracing means comprises at least one rigid member disposed in compression between a rear portion of the elongate upper portion and a portion of the watercraft when the tow line is held in tension by the water sporter being towed along the water surface.

* * * * *